United States Patent [19]

Mast, Jr. et al.

[11] 4,014,616

[45] Mar. 29, 1977

[54] DISPOSABLE PRODUCT APPLICATOR AND DISPENSING PACKAGE THEREFOR

[75] Inventors: John George Mast, Jr.; Paul James Green, both of Cincinnati, Ohio

[73] Assignee: The Procter & Gamble Company, Cincinnati, Ohio

[22] Filed: Mar. 18, 1976

[21] Appl. No.: 668,254

[52] U.S. Cl. ..... 401/292; 221/303; 221/57; 15/209 D

[51] Int. Cl.[2] ..... B65H 1/08; A47F 1/04

[58] Field of Search ..... 15/244 R, 209 D; 221/57–59, 303; 128/260, 271; 401/118, 130, 202, 6–8, 11, 12, 292

[56] References Cited

UNITED STATES PATENTS

| | | | |
|---|---|---|---|
| 1,713,588 | 5/1929 | Younghusband | 401/130 |
| 2,479,131 | 8/1949 | Pari | 15/209 D |
| 2,792,583 | 5/1957 | Alfano | 15/209 D |
| 3,860,348 | 1/1975 | Doyle | 401/202 X |

FOREIGN PATENTS OR APPLICATIONS

| | | | |
|---|---|---|---|
| 1,231,666 | 4/1960 | France | 15/209 D |

*Primary Examiner*—Lawrence Charles
*Attorney, Agent, or Firm*—Melville, Strasser, Foster & Hoffman

[57] ABSTRACT

Hand-held, generally T-shaped product applicators and a dispensing package for a stack thereof. Each applicator comprises a body portion and a handle portion. The body portion is dish-shaped with a convex bottom surface and a concave top surface. The bottom surface may be used directly to apply a product, or it may be provided with a product-applying facing. The handle portion is hollow and constitutes an integral, one-piece part of the body portion, extending upwardly from the top surface thereof. The hollow handle portion is open at the bottom surface of the body portion and closed at its top with upwardly and inwardly sloping edges and upwardly and inwardly sloping sides providing finger-grip surfaces. The handle portion of each applicator is so sized that the applicators may be stacked one above the other with their handle portions in telescoped relationship and the product applying facing of each applicator in spac ed relationship to the upper body portion surface of the applicator therebelow in the stack. The dispensing package is configured to receive a stack of applicators. The package has a dispensing opening at one end thereof through which the handle portion of the endmost applicator of the stack is exposed for removal therefrom. The opening is configured to release the applicators one at a time. Means are provided within the package to advance the stack of applicators toward the dispensing opening, as the applicators are removed therefrom.

28 Claims, 8 Drawing Figures

DISPOSABLE PRODUCT APPLICATOR AND DISPENSING PACKAGE THEREFOR

BACKGROUND OF THE INVENTION

1. Field of the Invention

This invention relates to disposable product applicators and a dispensing package therefor, and more particularly to hand-held, generally T-shaped disposable product applicators capable of being stacked with their handle portions in telescoped relationship and a package adapted to contain a stack of the applicators and to dispense them one at a time.

2. Description of the Prior Art

Prior art workers have developed various types of hand-held applicators, both reusable and disposable in nature. By way of example, Crawford U.S. Pat. No. 2,964,772 dated Dec. 20, 1960 teaches a resilient, T-shaped applicator for polishes, powders, creams and the like. T-shaped scouring pads are taught in Perkovich U.S. Pat. No. 3,097,387 dated July 16, 1963 and Perkovich et al U.S. Pat. No. 3,104,915 dated Sept. 24, 1963. Chase U.S. Pat. No. 1,791,351 dated Feb. 3, 1931 describes a stack of applicator pads or powder puffs for applying powder, rouge or the like. The pads are connected about their periphery and provided with a pull tab. The pads may be removed from the stack one-by-one.

Ebert et al U.S. Pat. No. 2,012,500 dated Aug. 27, 1935 teaches a hand-held, T-shaped manipulator for scouring pads. The manipulator is resilient and is provided with means by which it may be engaged with a scouring pad to serve as a handle therefor. Cleaves U.S. Pat. No. 2,048,103 dated July 21, 1936 illustrates a somewhat T-shaped flexible holder for a bag containing shoe polish.

Prior art workers have devised various types of stackable T-shaped applicators. One such applicator is taught in Anderson et al U.S. Pat. No. 3,131,410 dated May 5, 1964. In accordance with this patent, the T-shaped applicator is made stackable by virtue of the fact that its handle portion is foldable downwardly against the body of the applicator, rendering the applicator substantially flat and disc-shaped. In commonly owned copending U.S. application Ser. No. 668,253, filed in the name of John G. Mast and entitled A DISPOSABLE PRODUCT APPLICATOR AND DISPENSING PACKAGE THEREFOR, there is taught a resilient T-shaped applicator the disc-like body portion of which is foldable against itself so that the applicator will take on a flat, stackable configuration.

Prior art workers have devised packages for stacks of articles and having dispensing openings intended to enable the removal of one article at a time. By way of example, Ames U.S. Pat. No. 1,842,442 dated Jan. 26, 1932 teaches a cosmetic compact containing a stack of applicator pads. The compact has an opening therein so configured as to permit release of one pad at a time. Means are also provided to advance the stack of pads toward the dispensing opening. Hanna U.S. Pat. No. 1,671,285 dated May 29, 1928 describes a package for tablets, the discharge end of which is provided with a retaining member which holds the uppermost tablet of the stack in position to be manually removed laterally of the package. Eisner U.S. Pat. No. 3,620,412 dated Nov. 16, 1971 teaches an elongated package for storing resilient elements in a stack. The package has at one end a lipped edge which will permit the passage of the elements contained within the package. The elements are held in compressed configuration by a flexible, distortable closure which will not pass through the lipped edge unless appropriately distorted. Finally, Nordskog U.S. Pat. No. 3,717,282 dated Feb. 20, 1973 sets forth an elongated cylindrical dispenser for a stack of beverage cans. Means are provided to advance the stack toward the open end of the dispenser. The open end of the dispenser is provided with a retaining lip against which the uppermost can of the stack is held. The uppermost can may be shifted out from under the retaining lip and removed from the stack whereupon the next can of the stack will be engaged by the retaining lip.

The present invention provides hand-held, T-shaped disposable product applicators far simpler in construction than those hitherto known. As a consequence, the applicators can be readily and economically produced. The applicators are of novel dish-shaped configuration with hollow handle elements such that the applicators may be stacked with their handle elements in telescoped relationship. This results in significant packing volume reduction and the stacking arrangement permits the applicators to be spaced such that the product applying surface on each does not contact the applicator therebeneath, thus preventing product transfer.

The container of the present invention is adapted to receive a stack of the applicators and enables a number of applicators to be compactly stored and readily dispensed. Each applicator is dispensed with its handle portion foremost.

SUMMARY OF THE INVENTION

Each hand-held, generally T-shaped product applicator of the present invention comprises a dish-shaped body portion and an upstanding handle portion. The body portion has a convex bottom surface and a concave top surface. The bottom surface may be used directly to apply a product, or it may be provided with a product-applying facing.

The handle portion constitutes an integral, one-piece part of the body portion. The handle portion is located centrally of the concave top surface of the body portion and extends transversely and upwardly therefrom. The handle portion is hollow and closed at its upper end with its lower end opening at the bottom surface of the body portion. The handle portion has upwardly and inwardly sloping edges and upwardly and inwardly sloping sides. The sides provide finger-grip surfaces.

The handle portions of the applicators are so sized and configured that the applicators may be stacked one above the other with their handle portions in telescoped relationship and their product applying facings spaced from the top surface of the next adjacent applicator.

The dispensing package constitutes an elongated tubular member sized to receive a stack of applicators. At one end, the package is provided with a dispensing opening having an inturned lip or flange which will maintain the topmost applicator of the stack in position. The inturned lip defining the package dispensing opening may make a seal with the topmost applicator of the stack so as to assist in maintaining the applicators free of contamination and in preventing them from drying out. Each applicator may be pulled through the dispensing opening defined by the inturned lip or rim and the lip will catch and retain the next applicator of the stack so that the applicators are dispensed one at a time.

The package may also be provided with means to advance the stack of applicators toward the dispensing opening, as the applicators are removed therefrom. The package may also be provided with an overcap closing its dispensing opening.

DESCRIPTION OF THE PREFERRED EMBODIMENTS

Figure 1:
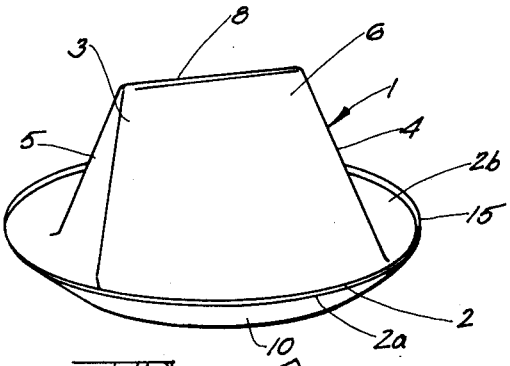
FIG. 1 is a perspective view of an applicator of the present invention.
Figure 2:
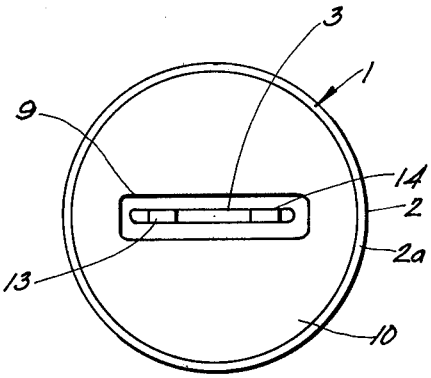
FIG. 2 is a bottom view of the applicator.
Figure 3:
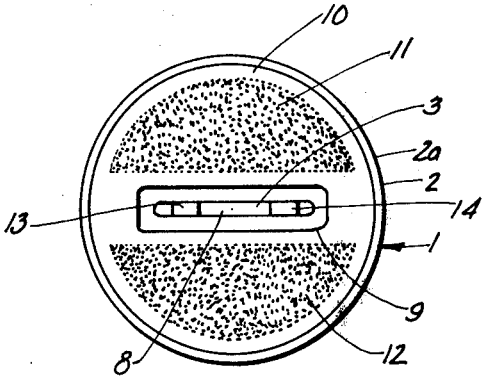
FIG. 3 is a bottom view, similar to FIG. 2 and illustrating the provision of a product on the applying facing of the applicator.
Figure 4:
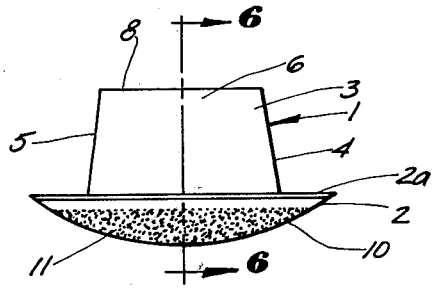
FIG. 4 is a side elevational view of the applicator of FIG. 3.
Figure 5:
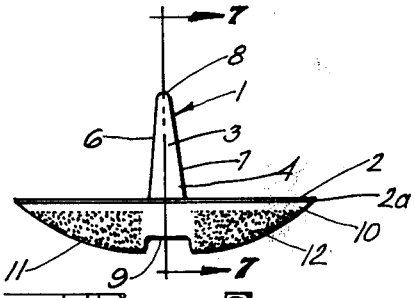
FIG. 5 is an elevational view of the applicator as seen from the right in FIG. 4.
Figure 6:
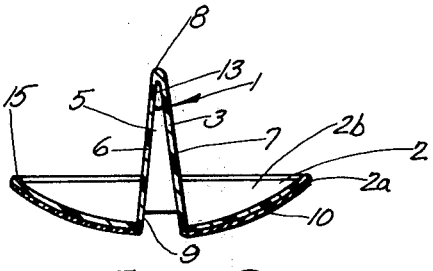
FIG. 6 is a cross sectional view taken along section lines 6—6 of FIG. 4.
Figure 7:
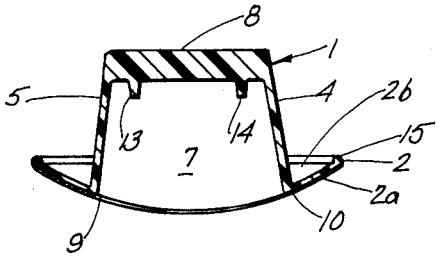
FIG. 7 is a cross sectional view taken along section lines 7—7 of FIG. 5.

The applicator of the present invention is illustrated in FIGS. 1 through 7 wherein like parts have been given like index numerals. The applicator is generally indicated at 1 and comprises a body portion 2 and a handle portion 3. The body portion 2 is dish-shaped having a convex bottom surface 2*a* and a concave top surface 2*b*. While body portion 2 is illustrated, for purposes of an exemplary showing, as having a circular peripheral configuration, the peripheral configuration may take any appropriate shape such as oval, rectangular or the like.

Handle portion 3 constitutes an integral, one-piece part of the body portion 2. The handle portion 3 may be located centrally and transversely of the upper surface 2*b* of body portion 2 and extends upwardly therefrom. Handle portion 3 has upwardly and inwardly sloping edges 4 and 5 and upwardly and inwardly sloping sides 6 and 7. Handle portion 3 is hollow (see FIGS. 2, 3, 6 and 7) and its upper edge may be closed as at 8. The bottom end of handle portion 3 defines an elongated slot-like opening 9 in the bottom surface 2*a* of body portion 2.

The applicator is preferably made of a stiff plastic such as polystyrene, high density polyethylene or the like. The applicators may be formed by any appropriate and well known method including thermoforming from sheet materials, injection molding, or the like. In selecting an appropriate plastic material from which to make the applicators, one should be chosen which will be compatable with the product to be applied by the structure.

The product to be applied by the applicator may take any appropriate form such as a liquid, a cream, a gel, a paste, a powder or the like. To this end, the bottom surface 2*a* of body portion 2 of the applicator is provided with an applying facing. Depending upon the nature of the product, the facing may take various forms. For example, the facing may constitute a layer of open pore foam material such that a product may be impregnated therein. On the other hand, a closed foam material may be used as the facing so as to prevent penetration and migration of the product therethrough. Facing 10 may be controlled pore structure to control the rate of deposition of a liquid product, for example, impregnated into the pores of the applicator pad. Some products may be applied directly to the bottom surface 2*a* of body portion 2, obviating the necessity of a facing 10. Cloth, felt or other material may be used as the facing. The facing may extend from the opening 9 in the bottom surface 2*a* of body portion 2 of the applicator to a position at, beyond or just short of the peripheral edge of body portion 2. In the Figures, a facing is shown at 10.

In an exemplary embodiment, the applicator of the present invention may be used to dispense a deodorant composition in the form of a cream. The applicator itself may be injection molded of high density polyethylene for compatability with the deoderant composition. The bottom surface 2*a* of the applicator may be provided with a facing of thermoformed polyethylene foam having a density of from about 2 pounds per cubic foot to about 6 pounds per cubic foot. The facing may, for example, be approximately 1/16 inch thick and thermoformed to yield a textured applying surface and providing controlled release of the product. The facing can be affixed to the applicator by adhesive means or it can be affixed as a part of the injection molding of the applicator. For a single day use a relatively thin coating of the product may be applied to the facing, while a relatively thicker coating of the product may be applied to the facing for a multi-day use.

In applying a product to the facing 10 of the applicator of the present invention it is preferred to space the product inwardly of the peripheral edge of the facing and inwardly of the opening 9 formed by handle element 3. This will eliminate any problem of product transferal to an adjacent applicator when the applicators are stacked (as will be described hereinafter). To this end, a product is preferably applied to the facing 10 in D-shaped segments, as illustrated at 11 and 12 in FIG. 3. The same general considerations will hold true when applying the product directly to the applicator surface 2. In the exemplary embodiment described above, wherein the applicators may be about 2 inches in diameter, product segments 11 and 12 may be spaced inwardly from the periphery of facing 10 and opening 9 by about ⅛ inch.

As indicated above, applicators of the present invention may be stacked. It is an advantage of the present invention that the applicators may be stacked with the hollow handle portion 3 of each within the hollow handle portion of the next highest applicator in the stack, the handle being in non-wedging relationship with the facng 10 (or bottom surface 2*a* if no facing is provided) of each applicator maintained out of contact with the upper surface 2*b* of the body portion of the next lowest applicator. The spacing required between adjacent applicators to accomplish this purpose will depend, in part, upon the thickness of the facing on the applicators. When required, the interior of each hollow handle portion 3 may be provided with means to establish the proper relationship between adjacent applicators of the stack. For example, one or more integral, one-piece webs may be located within the handle portion at the top thereof and extending transversely thereof to serve as stops to limit the depth to which each handle portion 3 enters the next and to prevent the telescoped handle portions from wedging. For purposes of an exemplary showing a pair of such webs are illustrated in FIGS. 2, 3, 6 and 7 at 13 and 14. Webs 13 and 14, when required, will be so sized as to prevent contact between the facing 10 of one applicator and the upper surface 2*b* of the next adjacent applicator therebelow, when the applicators are stacked. This will prevent product transferral from one applicator to the next and will assure that the finger grip surfaces 6 and 7 of each applicator handle portion 3 will be free of product when grasped by the fingers of the user. The webs 13 and 14 also may stiffen the handle portion 3, precluding inward movement of the finger grip surfaces 6 and 7 when grasped by the fingers of the user and may prevent wedging of the stacked handle portions and inadvertant removal of multiple applicators from the stack simultaneously.

The dish-shaped configuration of body portion 2 of the applicator not only lends strength and rigidity to the applicator but provides a convenient shape to the applying facing 10. Preferably, the peripheral edge of body portion 2 is provided with a bead 15 (most clearly shown in FIGS. 6 and 7). Bead 15 will not only lend strength to the structure, but also will assure that the peripheral edge of body portion 2 will not be so sharp, as to scratch the surface to which the product is to be applied. This is of particular importance when the applicator is used to apply a topical preparation.

The applicators of the present invention may be used to apply a wide variety of products to a wide variety of surfaces. While not intended to be so limited, the applicators can, for example, be used for topical preparations including cosmetic preparations, medicaments and the like. On the other hand, they may be used in non-topical applications such as to apply shoe polish to leather goods, or the like. While the facing 10 may be coated or impregnated with a product, or the bottom surface 2*a* of the applicator coated directly with a product, it is also within the scope of the invention to package the product separately from the applicators, the user applying the product to the applicator and using the applicator to apply the product to the desired surface.

Figure 8:
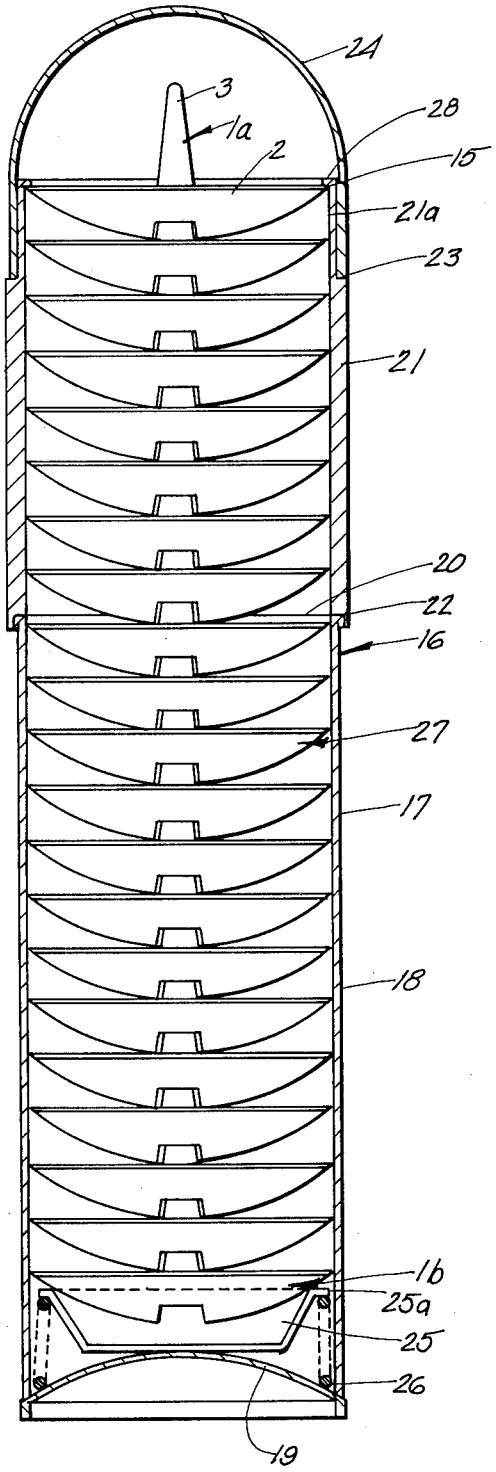
FIG. 8 is a cross sectional, elevational view of the package of the present invention with a stack of applicators located therein.

FIG. 8 illustrates an embodiment of the package of the present invention. The package is generally indicated at 16. In the exemplary embodiment illustrated the package is shown as made up of a conventional cylindrical can 17 having a cylindrical wall 18 and a bottom closure 19. Can 17 may be of the usual type used for aerosol containers and the like and has an open upper end 20. At the upper end, the can is provided with a cylindrical extension 21 having an annular notch 22 at its bottom end adapted to receive the upper end of can 17. The extension 21 can be permanently joined to can 17 by an appropriate adhesive or the like. The internal diameter of extension 21 may be substantially the same as the internal diameter of can 17 to provide a smooth, uninterrupted interior surface of a diameter slightly larger than the diameter of the applicators to be received therein. At its upper end, extension 21 has a portion 21*a* of reduced external diameter forming a shoulder 23 against which an overcap 24 may seat. The precise configuration of overcap 24 does not constitute a limitation on the present invention. For purposes of an exemplary showing, the overcap is illustrated as being substantially dome-shaped.

At its bottom end, the container 16 is provided with a dish-shaped follower 25 the outermost edge of which is in the form of an annular flange 25*a*. A long-stroke spring 26 is located between follower 25 and bottom closure 19 with one end abutting bottom closure 19 and the other end abutting follower flange 25*a*.

A stack of applicators of the type illustrated in FIGS. 1 through 7 is generally indicated at 27. The lowermost applicator 1*b* of the stack rests upon the flange 25*a* of follower 25. When the applicators are of the type having a predetermined quantity of product coated on surface 2*a* or coated on or impregnated in facing 10 thereof (see FIG. 3), it is preferable that the flange 25*a* of follower 25 contact that peripheral portion of the applicator not provided with product.

The upper end of extension 2 is open and has an inturned lip 28. Lip 28 defines a dispensing opening of a diameter slightly less than the diameter of the body portion 2 of the applicators. As is shown in FIG. 8, the uppermost applicator of stack 27 will be maintained in position by the abutment of the peripheral edge or rim 15 of its body portion 2 on the underside of lip 18. This will maintain stack 27 in position within container 16 and against the action of follower 25 and spring 26.

When it is desired to remove an applicator from container 16, it is only necessary to lift overcap 24 from the container and grasp the topmost applicator 1*a* 27 by its handle portion 3. A slight upward pull upon handle portion 3 will force the topmost applicator 1*a* past lip 28. Upon removal of the uppermost applicator, follower 25 and spring 26 will cause stack 27 to shift upwardly until the then endmost applicator of the stack is stopped by abutment with lip 28.

The abutment of the topmost applicator against lip 28 will minimize contamination of the remainder of the applicators in the stack in the absence of overcap 24. It is within the scope of the invention to so configure lip 28 or to coat it with an appropriate material such that a seal will be made between it and the uppermost applicator of the stack so that violatle products or the like may be applied to the facings of the applicators. It is also within the scope of the invention to so configure lip 28 as to make it discontinuous, so as to only engage the uppermost applicator at a plurality of spaced-apart peripheral locations. The lip 28 may also be spaced longitudinally inwardly of the open end of extension 21.

Since the applicators of the present invention have, for purposes of an exemplary showing, been illustrated in FIGS. 1 through 7 as being of circular configuration, the wall 18 of can 17 and the extension 21 are shown as being cylindrical. It will be understood that these elements may take any appropriate configuration to accommodate a stack of applicators having any desired peripheral configuration.

While package 16 has been illustrated as made up of the combination of a can-type container 17 and an extension 21, it will be understood by one skilled in the art that the package may comprises an integral, one-piece structure made of any appropriate material such as metal, plastic, paper board or the like. When an overcap 24 is used, it may have a friction fit with the upper end of the package (as illustrated in FIG. 8), or any other well known means can be provided to maintain the overcap on the package, including a snap fit means or the like.

It will be understood that the package of the present invention could be inverted so that applicators are dispensed from the bottom thereof. In this instance, a follower 25 and spring 26 may be provided, or gravity may be relied upon to assure the presence of an applicator at the dispensing end of the package.

Modifications may be made in the invention without departing from the spirit of it. For example, the entire applicator may be formed of a resilient foam material. Body portion 2 need not necessarily be dish-shaped. It can, for example, be flat so long as the applicators can be stacked.

The embodiments of the invention in which an exclusive property or privilege is claimed are defined as follows:

1. A hand-held, generally T-shaped disposable product applicator comprising a body portion and a handle portion, said body portion having product-applying bottom surface and a top surface, said handle being located on said top surface and extending transversely thereof and upwardly therefrom, said handle portion having upwardly and inwardly sloping side walls and upwardly and inwardly sloping side edges, said side walls providing finger-grip surfaces, said handle portion being hollow, said bottom surface of said body portion having an opening therein leading to the interior of said hollow handle portion, said applicator being stackable with a similar applicator with their handle elements in telescoped relationship.

2. The structure claimed in claim 1 including a product-applying facing layer on said bottom surface of said body portion.

3. The structure claimed in claim 1 wherein said handle portion comprises an integral, one-piece part of said body portion.

4. The structure claimed in claim 1 wherein said body portion has a circular peripheral configuration.

5. The structure claimed in claim 1 including a bead formed along the peripheral edge of said body portion to prevent said edge from being sharp.

6. The structure claimed in claim 1 wherein the product to be applied by said applicator is coated on bottom surface of said body portion.

7. The structure claimed in claim 1 wherein said handle portion is so configured that when a plurality of said applicators are stacked with their handle portions in telescoped condition said handle portions will be in non-wedging relationship and said bottom surface of each applicator will be spaced from said top surface of the adjacent applicator therebelow.

8. The structure claimed in claim 1 wherein said handle portion has a closed upper end, at least one web being located within said hollow handle portion adjacent said closed upper end thereof, said web extending between said handle portion side walls, said web comprising a depth-determining stop means for the handle portion of another similar applicator when said applicators are in stacked condition with their handle portions in telescoped relationship.

9. The structure claimed in claim 1 including a plurality of said applicators in stacked condition with their handle portions in telescoped relationship, a dispensing package, said stack of applicators being located in said package, said package having a first closed end and a second end with a dispensing opening through which the endmost applicator of said stack may be removed from said package one at a time and means to advance said stack toward said dispensing opening.

10. The structure claimed in claim 2, wherein the product to be applied by said applicator is coated on said facing layer.

11. The structure claimed in claim 2 wherein said product to be applied by said applicator is impregnated in said facing layer.

12. The structure claimed in claim 2 wherein said facing layer comprises a textured layer.

13. The structure claimed in claim 2 wherein said facing layer is formed of a controlled pore material.

14. The structure claimed in claim 2 wherein said facing layer is formed of a closed foam material.

15. The structure claimed in claim 2 wherein said facing layer is formed of an open foam material.

16. The structure claimed in claim 2 wherein said handle portion is so configured that when a plurality of said applicators are stacked with their handle portions in telescoped condition said handle portions will be in non-wedging relationship and said facing layer of each applicator will be spaced from said top surface of the adjacent applicator therebelow.

17. The structure claimed in claim 3 wherein said body and handle portions are molded of high density polyethylene.

18. The structure claimed in claim 3 wherein said body and handle portions are molded of polystyrene.

19. The structure claimed in claim 6 wherein said product is spaced inwardly of said opening in said bottom surface of said body portion and inwardly of the peripheral edge of said body portion.

20. The structure claimed in claim 9 including an overcap to close said dispensing opening.

21. The structure claimed in claim 9 wherein said means to advance said stack toward said dispensing opening comprises a follower beneath said stack and a spring between said follower and said first closed package end.

22. The structure claimed in claim 9 wherein said second end of said package is open and is provided with an inturned lip, said lip defining said dispensing opening, said dispensing opening being slightly smaller than said body portion of said applicators, the peripheral edge of said body portion of said topmost applicator of said stack abutting said lip to maintain said stack within said package, the handle portion of said topmost applicator extending through said dispensing opening whereby said handle portion of said topmost applicator may be grasped by the user and a pulling force applied thereto to remove said topmost applicator from said package past said lip, whereupon the next applicator will be engaged and retained by said lip.

23. The structure claimed in claim 10 wherein said product is spaced inwardly of said opening in said bottom surface of said body portion and inwardly of the peripheral edge of said body portion.

24. The structure claimed in claim 11 wherein said product is spaced inwardly of said opening in said bottom surface of said body portion and inwardly of the peripheral edge of said body portion.

25. The structure claimed in claim 17 wherein said facing layer comprises a textured layer of thermoformed polyethylene foam of a density of from about 2 pounds per cubic foot to about 6 pounds per cubic foot and a thickness of about 1/16 inch.

26. The structure claimed in claim 22 wherein the body portions of said applicators of said stack are of circular peripheral configuration, said package having a cylindrical side wall of an internal diameter to receive said applicators with a sliding fit, said dispensing opening defined by said lip being circular and of a diameter slightly less than the diameter of said body portion of each of said applicators.

27. The structure claimed in claim 22 wherein said lip and abutting peripheral edge of said topmost applicator of said stack form a seal for said dispensing opening.

28. The structure claimed in claim 22 wherein said facing layer of each of said applicators of said stack is spaced from said top surface of the adjacent applicator therebelow.

* * * * *

UNITED STATES PATENT AND TRADEMARK OFFICE

CERTIFICATE OF CORRECTION

PATENT NO. : 4,014,616

DATED : March 29, 1977

INVENTOR(S) : John George Mast, Jr. and Paul James Green

It is certified that error appears in the above-identified patent and that said Letters Patent are hereby corrected as shown below:

Column 6, line 14, "2" should be...21...

Column 6, line 20, "18" should be...28...

Column 6, line 25, after "la" add...of stack...

Signed and Sealed this

Fourteenth Day of June 1977

[SEAL]

*Attest:*

RUTH C. MASON
*Attesting Officer*

C. MARSHALL DANN
*Commissioner of Patents and Trademarks*